United States Patent [19]

Horii et al.

[11] 4,426,006

[45] Jan. 17, 1984

[54] METHOD AND APPARATUS FOR SORTING FRUITS, VEGETABLES OR THE LIKE BY WEIGHT

[75] Inventors: Taichi Horii; Taro Horii; Kazuo Haraguchi, all of Hamamatsu, Japan

[73] Assignee: Mitsubishi Denki Kabushiki Kaisha, Tokyo, Japan

[21] Appl. No.: 335,668

[22] Filed: Dec. 30, 1981

[30] Foreign Application Priority Data

Jul. 9, 1980 [JP] Japan ..... 55-93491

[51] Int. Cl.[3] ..... B07C 5/28

[52] U.S. Cl. ..... 209/593; 209/912; 177/145

[58] Field of Search ..... 209/592, 593, 594, 595, 209/513, 912; 177/145, 199, 263; 198/502, 504, 655, 656

[56] References Cited

U.S. PATENT DOCUMENTS

| | | | |
|---|---|---|---|
| 4,106,628 | 8/1978 | Warkentin et al. | 209/593 |
| 4,254,877 | 3/1981 | Rose | 209/594 |
| 4,262,807 | 4/1981 | Leverett | 209/592 |

*Primary Examiner*—Robert B. Reeves
*Assistant Examiner*—Donald Hajec
*Attorney, Agent, or Firm*—Wenderoth, Lind & Ponack

[57] ABSTRACT

A method and an apparatus for sorting fruits, vegetables or the like by weight. An electronic weighing device is used in combination with a basket conveyer system arranged by mounting evenly spaced receiving or weighing baskets on a chain conveyer. The basket are loosely mounted on the mounting metal members of the chain conveyer. Each time a basket is conveyed over a weighing stand of the weighing device, the basket is detached from the mounting member and is pushed so as to slide over a measuring rail by a freely rotatable pushing member which has small frictional resistance and is arranged to be in pushing contact with a vertical face of the basket.

8 Claims, 7 Drawing Figures

METHOD AND APPARATUS FOR SORTING FRUITS, VEGETABLES OR THE LIKE BY WEIGHT

BACKGROUND OF THE INVENTION

1. Field of the Invention:

This invention relates to a method and an apparatus for sorting fruits, vegetables or the like by various grades of weight by putting them piece by piece on baskets.

2. Description of the Prior Art:

Heretofore apparatuses of two types have been employed in general in sorting fruits and vegetables by weight. On one type of such conventional apparatuses, many balances with receiving backet-like baskets having a Roberval mechanism are mounted on and evenly spaced along an endless travelling chain to form a basket conveyer. Along one side of the travelling path of the baskets of the conveyer, a lever balance is fixedly provided at each of discharge positions which are allocated to sorting grades predetermined for a fruit or a vegetable for sorting by weight, such as 3L, 2L, L, M, S, 2S and 3S. In the other type, a Roberval mechanism is formed at the mounting frame of each receiving basket. The mounting frames are mounted on mounting metal members provided between two lines of chain to form a basket conveyer of the traction type. The baskets of the conveyer are allowed to travel over balances arranged for different grades of weight and are fixedly provided at discharge positions allocated to the different grades. At these lever balances, the baskets are balanced against weights set for the different grades. Through this balancing process, the baskets descend and hang down to have the fruit or vegetable sorted by weight. Since the receiving baskets which are arranged to put the fruit or vegetable thereon are mounted by a Roberval mechanism, the conventional apparatuses have many links and fulcrums for mounting the receiving baskets. The resistance of contacting parts of one basket differs from that of another basket while hundreds of baskets are used for each unit of the sorting apparatus. These baskets and 6 to 8 stationary balances which are provided for different sorting grades must be adjusted to a uniform sensitivity. However, such adjustment requires much labor. Hence, the conventional apparatuses tend to be used without adequate adjustment. The inadequate adjustment naturally has resulted in unsatisfactory sorting.

It has been another shortcoming of the conventional sorting apparatuses that the complex structure of the baskets tends to cause them to get out of order.

This invention is directed to the elimination of these shortcomings of the conventional sorting apparatuses by utilizing the recently advanced technology of electronics applied to and embodied in measuring instruments, which are capable of covering a wide ranged values of weight through a very slight degree of displacement of a weighing receiver plate.

SUMMARY OF THE INVENTION

It is therefore a general object of the invention to provide a sorting apparatus which eliminates the shortcomings of the conventional sorting apparatuses of the types described in the foregoing. The sorting apparatus according to the invention uses receiving baskets of simple construction and is capable of weighing and sorting at a high speed and at a high degree of accuracy as well as being arranged for ease of weight adjustment and simple operation. In accordance with the invention, the mounting part of each receiving basket (hereinafter called the basket) is loosely mounted on a corresponding mounting metal member of a chain conveyer with clearances of about several millimeters provided above, below and on the left, right, front and rear sides of the mounting part. The basket is further provided with a vertical face at a part thereof. A pushing member such as a bearing, a roller or the like is arranged to abut on the vertical face to be rotatable up and down thereon and is disposed in a position to allow the above stated loose mounting part of the backet to have even clearances on the front and rear sides thereof. Many baskets, each of which is arranged in this manner, are thus mounted on the mounting metal members of the chain conveyer to form a sorting basket conveyer. An electronic weighing device is disposed beneath the travelling path of these baskets. The weighing stand (hereinafter called a measuring rail) of the weighing device is set at such a height that the loose mounting part of each basket has even clearances on the upper, lower, left and right sides or has a somewhat greater clearance on the upper side than the clearances on other sides when the basket slides over the measuring rail. The object of the invention is attained with the loose mounting part thus arranged to stay out of touch with the corresponding mounting metal member of the chain conveyer under this condition while the basket is pushed by the freely rotatable pushing member.

The above and further objects, features and advantages of the invention will become apparent from the following detailed description of embodiments thereof taken in connection with the accompanying drawings.

BRIEF DESCRIPTION OF THE DRAWINGS

All the accompanying drawings show embodiment examples of the present invention.

DETAILED DESCRIPTION OF PREFERRED EMBODIMENTS

Figure 1:
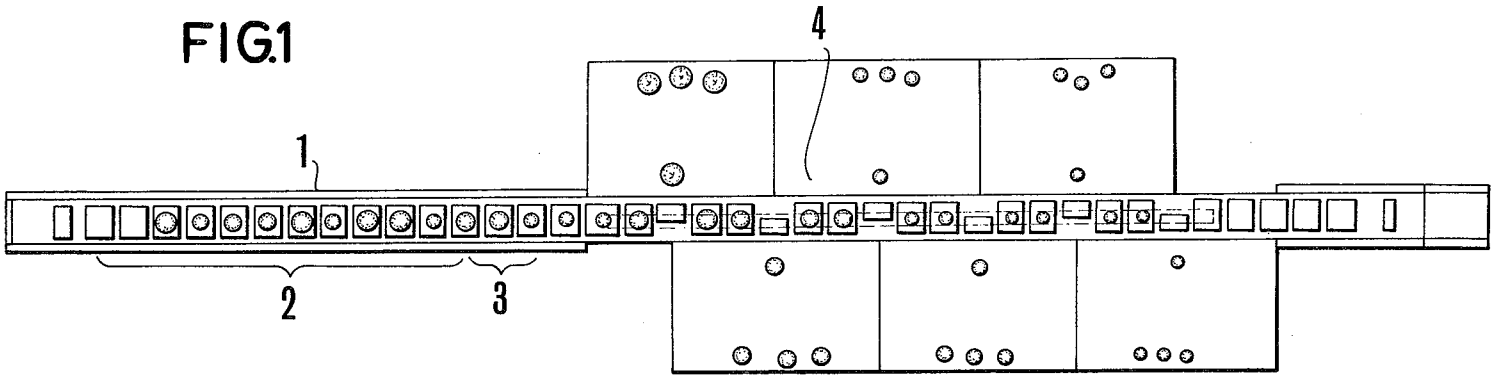
FIG. 1 is a plan view showing the entire arrangement of a weight sorting apparatus according to the invention.
Figure 2:
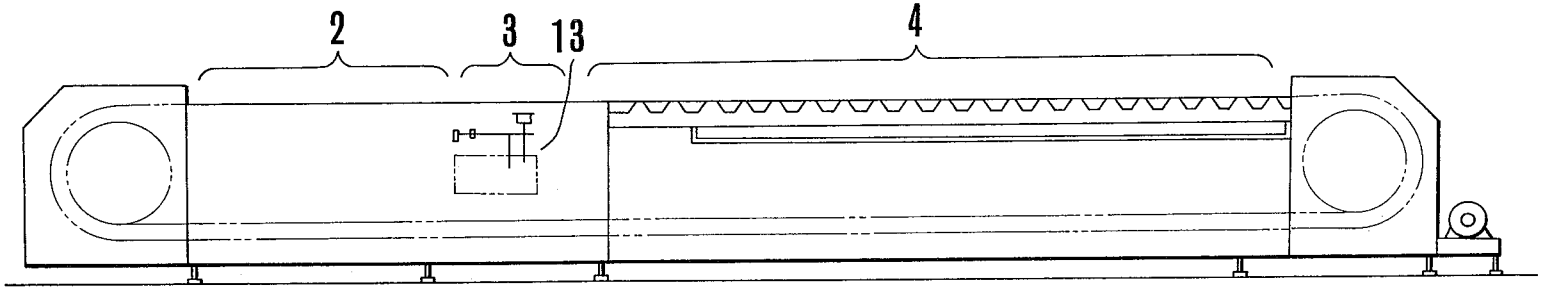
FIG. 2 is a side view of the same apparatus.
Figure 3:
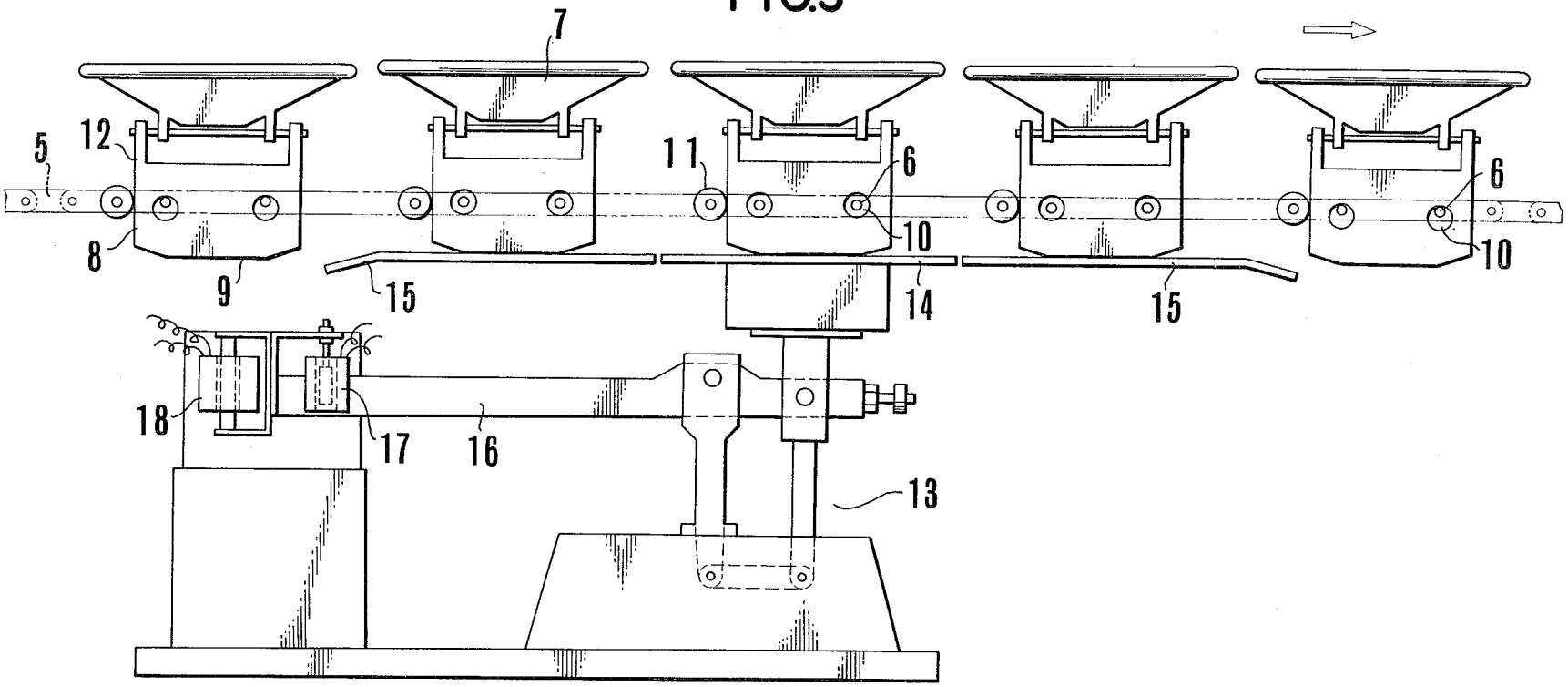
FIG. 3 is a schematic illustration showing the essential parts of the apparatus including baskets in combination with a weighing device.

Referring to the accompanying drawings which show preferred embodiments of the invention, the weight sorting apparatus 1 has a basket conveyer consisting of a supply section 2, a weighing section 3 and a fruit distributing section 4. Each of these sections is arranged over a required length.

In the sorting apparatus 1, a conveyer chain 5 has many mounting metal members (shafts) 6 attached and evenly spaced thereon. The chain is arranged to travel in a circulating manner. There are provided backet-like baskets 7. The upper part of each basket 7 is formed into a receiving pan-like shape. A body part 8 is arranged below the receiving pan part while a sliding part 9 is formed in the lower part of the basket. The body part 8 of the basket is provided with opposing sidewalls having opposing openings or mounting holes 10. Each mounting hole 10 is arranged to loosely mount the basket on a mounting metal member 6 leaving clearances of about 3 mm on the upper, lower, front and rear sides of the mounting metal member 6. The body part 8 is provided with a vertical face 12.

Each basket 7 is arranged to be pushed by a pushing member 11. The pushing member 11 is freely rotatable and is arranged to abut on the vertical face 12 of the basket in a position to allow the mounting hole 10 to have even clearances on the front and rear sides thereof relative to the mounting metal member 6.

Figure 4:
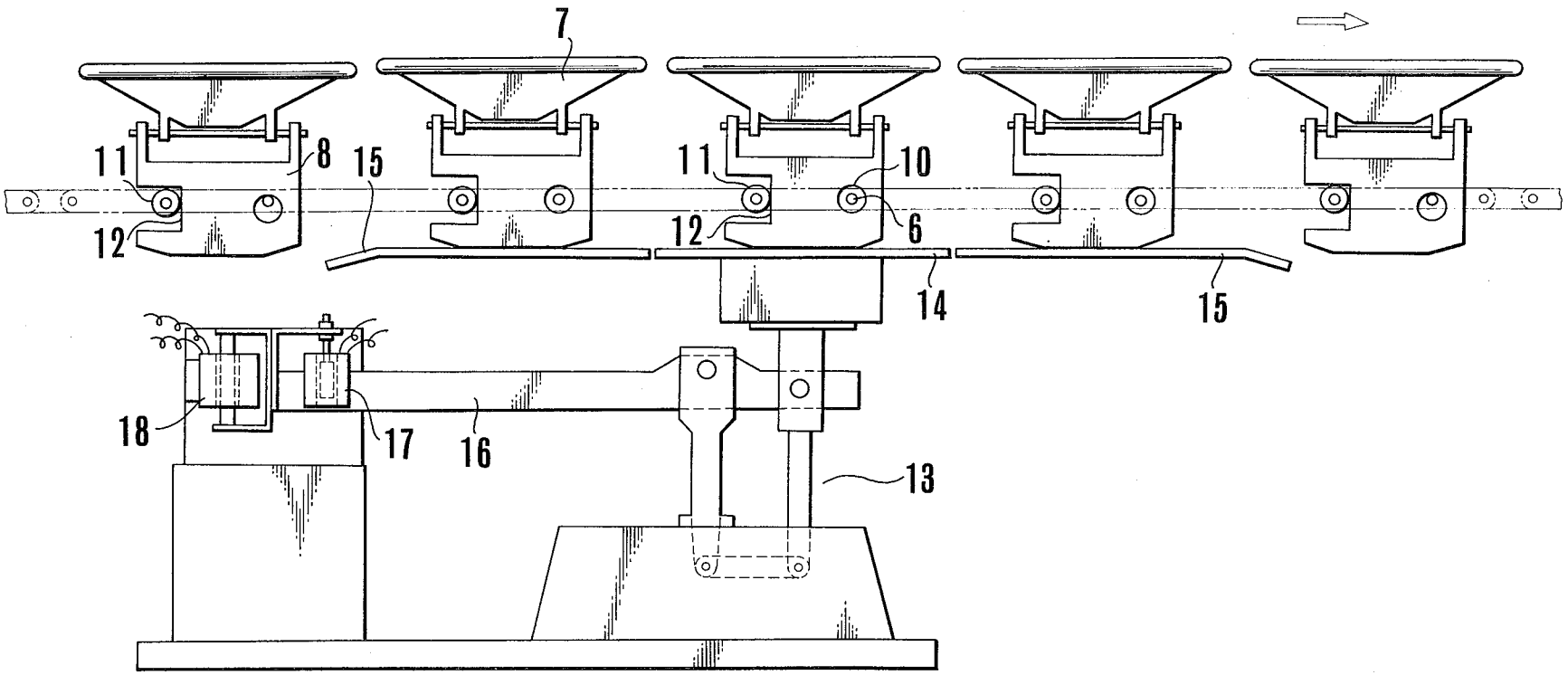
FIG. 4 is a schematic illustration showing a modification of the same essential parts as a second embodiment of the invention.
Figure 5:
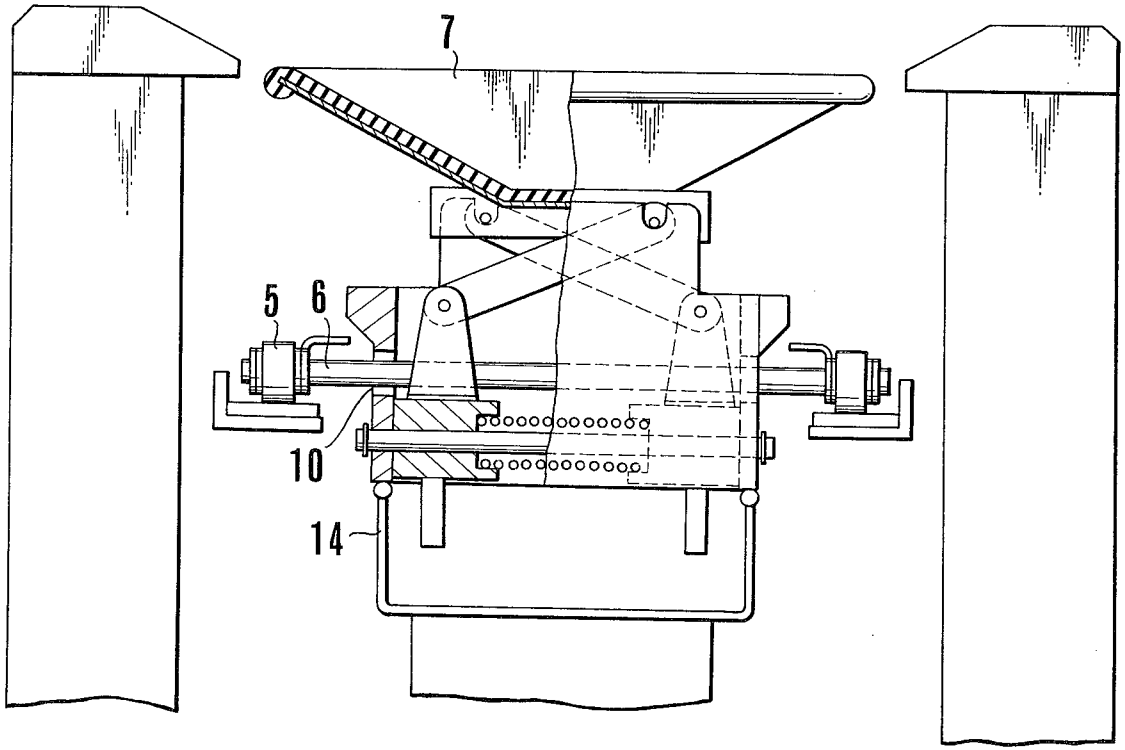
FIG. 5 is partially sectional view showing the coupling arrangement of a basket and a measuring rail.
Figure 6:
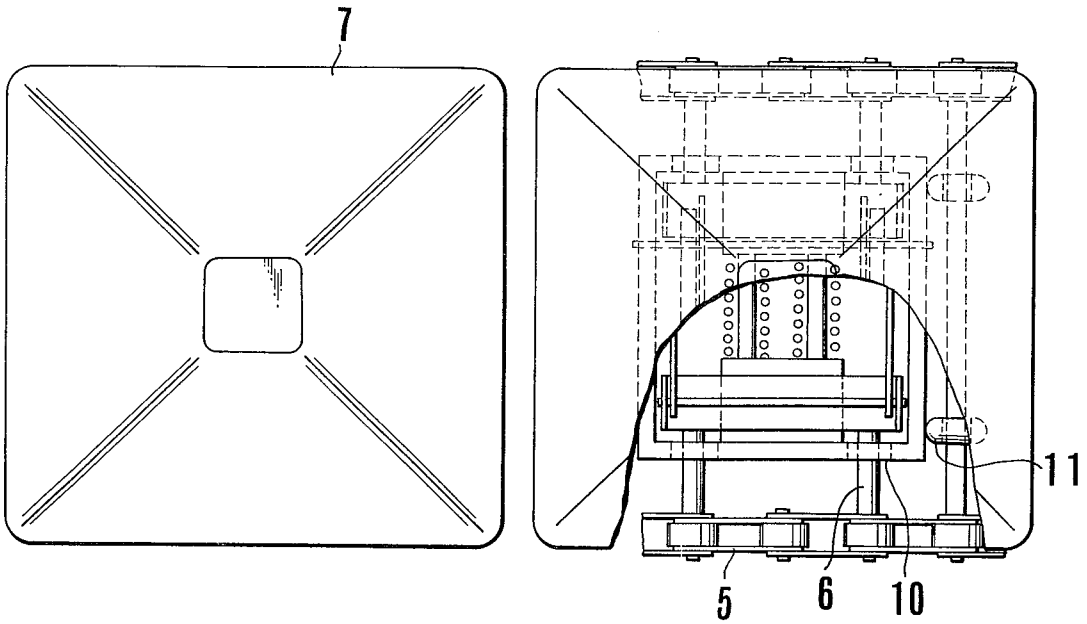
FIG. 6 is a plan view showing the essential parts of the basket.
Figure 7:
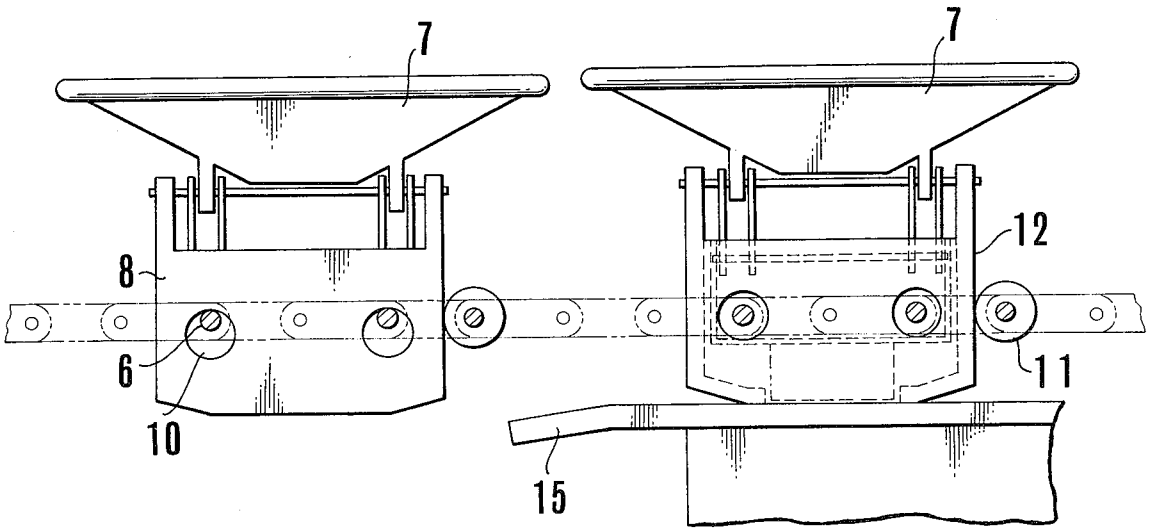
FIG. 7 is a side view of FIG. 6.

The pushing members 11 are low rotational friction members as bearing, rollers, balls, etc. The pushing member may be arranged to also serve the additional purpose of mounting the basket 7 in a manner as shown in Fig. 4.

A weighing device 13 is installed below the travelling path of the baskets at the weighing section 3 of the basket chain conveyer.

The weighing device 13 is provided with a measuring rail 14, which is arranged at such a height that the mounting hole 10 (or a loose fitting part) has even clearances on the upper and lower sides relative to the mounting member 6 when the sliding part 9 of each basket 7 travels over the upper surface of the measuring rail 14. In other words, the clearance on the upper side decreases when the basket is empty and the clearance on the lower side decreases when the basket is loaded with the fruit.

The measuring rail 14 is arranged in combination with guide rails 15, which are arranged to receive the sliding part 9 of each basket 7. One of the guide rails 15 serves to adjust the height of the sliding part 9 to the height of the upper surface of the measuring rail 14. The other guide rail 15 serves to ensure smooth travel of the basket without any impact and vibration when the sliding part 9 comes away from the measuring rail 14 after riding on the measuring rail 14.

The weighing device 13 is an electronic weighing instrument of the force balance type. When the measuring rail 14 is loaded, the rail 14 sinks to a slight extent to cause a displacement of a lever 16. A differential transformer 17 senses this displacement and feeds this back through an amplifier to a coil 18 to keep the lever 16 and the measuring rail 14 at their respective preset levels. With the weighing device arranged in this manner, the measuring rail 14 is allowed to move up and down to only a very slight extent. This ensures that the basket 7 is kept out of contact with the mounting metal member 6 so that weighing can be accurately performed. Although the pushing member 11 is in contact with the body part of the basket 7 in this instance, the contact friction does not affect weighing accuracy because the basket sinks only a very slight amount and, besides, the pushing member 11 itself is arranged to be movable up and down in a rotating menner.

The weighing device 13 may be a weighing instrument using a load cell or a weighing instrument of some other type. However, a great amount of the upward and downward displacement of the measuring rail would necessitate an increase in the amount of the loose mounting clearances provided between the mounting holes and the mounting metal members. It is, therefore, preferable to use a weighing device which has a minimal degree of displacement of the measuring rail.

The mounting metal members 6 for the baskets are not limited to round rods. They may be formed into a square shape, an L-shape or some other sectional shape as desired with the shape of the corresponding loose mounting holes of the baskets also suitably determined accordingly.

In this particular embodiment, the mounting metal members are arranged by connecting two lines of chain therewith. However, they may be arranged to separately protrude slightly from the left and right chains.

With the weighing device arranged in the manner as described above, the weight of the fruit or vegetable which is placed on each basket is measured together with the basket. Then, to sort and classify the fruit or vegetable in accordance with predetermined weight values of sorting grades, a sorting signal is transmitted in synchronism with the baskets to an applicable one of sorting devices which are installed in the fruit distributing section 4 located at a farther point of the conveyer. In response to the sorting signal, the sorting device assigned to the applicable grade is actuated to discharge the fruit or vegetable from the basket.

The sorting apparatus which is arranged as described in the foregoing in accordance with the invention measures the weight of the fruit or vegetable together with the baskets while the basket is detached from the mounting metal members. This dispenses with the use of a Roberval mechanism for the basket for correction of an eccentric load on the receiving pan part thereof. Therefore, this permits simplification of the construction of the apparatus. In addition to this advantage, the use of the electronic weighing device enables the apparatus to perform a sorting operation at a high speed and with a high degree of accuracy.

Further, the baskets may be conveyed either in a mode of the traction type in which they are pulled from the front or in a mode of pushing them from behind. Therefore, a fruit or vegetable can be accurately sorted by weight irrespective of the heaviness or lightness thereof. Additionally, providing the weighing device beneath the travelling path of the baskets within the width of the path permits reduction in spacing between one line of the basket conveyer and another in the case of a multi-line basket conveyer system. The invention, therefore, permits reduction in the width of the apparatus to facilitate a feeding process, etc. and improvement in the operability of the apparatus.

What is claimed is:

1. In an apparatus for sorting articles by weight, in which an article to be sorted is transported longitudinally in a basket along a chain conveyor to a weighing device for weighing the basket and article therein, the improvement wherein:

the conveyor includes a mounting member fixed thereto and longitudinally movable therewith for attachment to said basket;

said basket being loosely disengagably mountable on said mounting member so as to be vertically and longitudinally movable with respect thereto, said basket having a lower surface and a vertical abutting face;

a rotatable pushing member mounted for longitudinal movement with said chain conveyor, abutting said vertical face for pushing said basket longitudinally along said conveyor;

a weighing device disposed along said conveyor, for weighing said basket and the article therein, including a rail having means for slidably engaging said lower surface to raise said basket and concurrently disengaging said basket from said mounting member, without separating said pushing member from said vertical face, said basket being slidable onto said rail along said lower surface.

2. The improvement as in claim 1, wherein said apparatus includes a plurality of baskets and corresponding mounting members disposed along said conveyor.

3. The improvement as in claim 1, wherein said basket comprises spaced opposing sidewalls having spaced opposing openings therein, said mounting member comprises a shaft extending through said opposing openings so as to be engagable with the edges of said openings and being vertically and longitudinally movable therein, said means for slidably engaging said lower surface comprising means for disengaging said edges from said shaft.

4. The improvement as in claim 3, wherein said engaging means comprises a measuring rail and two guide rails located on longitudinally opposite sides of said measuring rail, said measuring rail being vertically movable relative to said two guide rails, said guide rails including ramps for respectively slidably raising and lowering said basket onto and from said measuring rail and respectively concurrently disengaging and engaging said shaft from and with said edges of said openings.

5. The improvement as in claim 1, wherein said engaging means comprises a measuring rail and two guide rails located on longitudinally opposite sides of said measuring rail, said measuring rail being vertically movable relative to said two guide rails, said two guide rails including ramps for respectively slidably raising and lowering said basket onto and from said measuring rail and respectively concurrently disengaging and engaging said basket from and with said mounting member.

6. In a method of sorting articles by weight in which an article to be weighed is transported longitudinally in a basket by a chain conveyor and slid onto and off of a weighing device along the conveyor for weighing the basket and article therein, the improvement wherein said method includes the steps of:

(1) loosely mounting the basket on a mounting member of a chain conveyor for longitudinal movement therewith with the mounting member in contact therewith, (2) pushing the basket longitudinally at a vertical face thereof with a rotatable pushing member abutting the vertical surface, (3) measuring the weight of the article and the basket while pushing the basket with the pushing member such that the basket slides over a measuring rail over a weighing stand of the weighing device, (4) disengaging the mounting members form the basket so that the basket is disengaged from the mounting member and moved only by the pushing member during said measuring step; and (5) sorting the article by weight after said measuring step.

7. The improvement as in claim 6, further including the step of reengaging the basket with the mounting member after said measuring step.

8. The improvement as in claim 7, wherein the step of disengaging includes the step of slidingly raising the basket on a first guide rail located along the conveyor on one longitudinal side of the measuring rail, and the step of reengaging includes the step of slidingly lowering the basket on a second guide rail located along the conveyor on the other longitudinal side of the measuring rail.

* * * * *

UNITED STATES PATENT AND TRADEMARK OFFICE

CERTIFICATE OF CORRECTION

PATENT NO. : 4,426,006

DATED : January 17, 1984

INVENTOR(S) : Taichi Horii, Taro Horii, Kazuo Haraguchi

It is certified that error appears in the above-identified patent and that said Letters Patent is hereby corrected as shown below:

On the cover sheet of the patent in the space [73] provided for the name of the Assignee, delete "Mitsubishi Denki Kabushiki Kaishi,
Tokyo, Japan", and insert --Kabushiki Kaishi Maki Seisakusho--

Signed and Sealed this

*Nineteenth* Day of *November 1985*

[SEAL]

*Attest:*

DONALD J. QUIGG

*Attesting Officer*

*Commissioner of Patents and Trademarks*